US011262050B2

(12) United States Patent
Wang et al.

(10) Patent No.: US 11,262,050 B2
(45) Date of Patent: Mar. 1, 2022

(54) LIGHTING FIXTURE

(71) Applicants: OPPLE LIGHTING CO., LTD., Shanghai (CN); SUZHOU OPPLE LIGHTING CO., LTD., Suzhou (CN)

(72) Inventors: Guoping Wang, Shanghai (CN); Qingjun Wei, Shanghai (CN); Zenglong Zhu, Shanghai (CN); Dongjing Yu, Shanghai (CN)

(73) Assignees: Oppie Lighting Co., Ltd., Shanghai (CN); Suzhou Oppie Lighting Co., Ltd., Suzhou (CN)

( * ) Notice: Subject to any disclaimer, the term of this patent is extended or adjusted under 35 U.S.C. 154(b) by 0 days.

(21) Appl. No.: 17/136,599

(22) Filed: Dec. 29, 2020

(65) Prior Publication Data

US 2021/0116105 A1 Apr. 22, 2021

Related U.S. Application Data

(63) Continuation of application No. PCT/CN2019/126053, filed on Dec. 17, 2019.

(30) Foreign Application Priority Data

Dec. 17, 2018 (CN) ..... 201822118050.6

(51) Int. Cl.
*F21S 8/08* (2006.01)
*F21V 17/06* (2006.01)
(Continued)

(52) U.S. Cl.
CPC ..... *F21V 17/06* (2013.01); *F21S 8/085* (2013.01); *F21V 5/007* (2013.01); *F21V 17/16* (2013.01);
(Continued)

(58) Field of Classification Search
CPC ..... F21S 8/085; F21V 5/007; F21V 17/16; F21V 17/164; F21V 31/005; F21V 31/03; F21V 3/00; F21V 17/06
See application file for complete search history.

(56) References Cited

U.S. PATENT DOCUMENTS 4,158,222 A * 6/1979 Cook ..... F21V 5/02 359/742
7,125,152 B2 * 10/2006 Lin ..... G02B 6/009 362/609
(Continued)

FOREIGN PATENT DOCUMENTS

CN 203215478 U 9/2013
CN 106224905 A 12/2016
(Continued)

OTHER PUBLICATIONS

International Search Report (including English translation) and Written Opinion issued in PCT/CN2019/126053, dated Mar. 19, 2020, 7 pages.

*Primary Examiner* — Arman B Fallahkhair
(74) *Attorney, Agent, or Firm* — Arch & Lake LLP

(57) ABSTRACT

A lighting fixture is provided. The lighting fixture includes a housing, a light source assembly, a lens cover, and an anti-deformation assembly, the housing and the lens cover are connected and form a mounting space; the light source assembly is mounted in the mounting space and includes a light source panel, and a connection through-hole is provided in the light source panel; the lens cover includes a cover body and a lens unit on the cover body; and a part of the anti-deformation assembly is in the connection through-hole, and the anti-deformation assembly is connected to the lens unit to apply an action force to the lens unit to cause the lens unit to fit the light source panel.

18 Claims, 8 Drawing Sheets

(51) Int. Cl.

| | |
|---|---|
| ***F21V 31/00*** | (2006.01) |
| ***F21V 17/16*** | (2006.01) |
| ***F21V 31/03*** | (2006.01) |
| ***F21V 5/00*** | (2018.01) |
| *F21Y 105/16* | (2016.01) |
| *F21Y 115/10* | (2016.01) |
| *F21V 3/00* | (2015.01) |
| *F21W 131/103* | (2006.01) |

(52) U.S. Cl.
CPC ..... *F21V 17/164* (2013.01); *F21V 31/005* (2013.01); *F21V 31/03* (2013.01); *F21V 3/00* (2013.01); *F21W 2131/103* (2013.01); *F21Y 2105/16* (2016.08); *F21Y 2115/10* (2016.08)

(56) References Cited

U.S. PATENT DOCUMENTS

| | | | | |
|---|---|---|---|---|
| 9,416,947 | B2 * | 8/2016 | Guo | F21V 23/06 |
| 10,704,765 | B2 * | 7/2020 | Shellhause | F21S 41/285 |
| 2010/0254148 | A1 * | 10/2010 | Huang | F21S 4/28 362/373 |
| 2011/0058387 | A1 * | 3/2011 | Matsunaga | F21V 17/164 362/547 |
| 2012/0188766 | A1 * | 7/2012 | Lu | F21V 29/763 362/249.02 |
| 2012/0300456 | A1 * | 11/2012 | Phillips, III | F21V 5/04 362/245 |
| 2015/0204491 | A1 * | 7/2015 | Yuan | F21V 5/045 362/311.02 |
| 2016/0215955 | A1 * | 7/2016 | Donato | F21V 5/04 |

FOREIGN PATENT DOCUMENTS

| | | | |
|---|---|---|---|
| CN | 104428589 | B | 5/2017 |
| CN | 206191529 | U | 5/2017 |
| CN | 207146077 | U | 3/2018 |
| CN | 209012945 | U | 6/2019 |
| KR | 101310365 | B | 9/2013 |

* cited by examiner

LIGHTING FIXTURE

CROSS-REFERENCE TO RELATED APPLICATIONS

This application is based upon and claims the priority of PCT patent application No. PCT/CN2019/126053 filed on Dec. 17, 2019 which claims priority to the Chinese patent application No. 201822118050.6 filed on Dec. 17, 2018, the entire content of all of which is hereby incorporated by reference herein for all purposes.

TECHNICAL FIELD

The present disclosure relates to the technical field of lighting devices, and particularly, to a lighting fixture.

BACKGROUND

Performances of lighting fixtures have been greatly improved as people have higher requirements for ambient lighting. There are many types of lighting fixtures. Taking street lamps as an example, a street lamp mainly may include a housing, a light source assembly, a driver and a lens cover. The housing and the lens cover are mounted together, and a mounting space for mounting the light source assembly and the driver is formed therebetween. The light source assembly may include components, such as a light source panel, light-emitting units, and a light distribution element, and the like. The light distribution element covers the light-emitting units to realize the scattering emission of light.

SUMMARY OF THE UTILITY MODEL

The present disclosure discloses a lighting fixture and a method of manufacturing a lighting fixture.

The present disclosure provides a lighting fixture. The lighting fixture may include a housing, a light source assembly, a lens cover, and an anti-deformation assembly. The housing and the lens cover may be connected and form a mounting space; the light source assembly may be mounted in the mounting space and may include a light source panel, and a connection through-hole may be provided in the light source panel; the lens cover may include a cover body and a lens unit on the cover body; and a part of the anti-deformation assembly may be in the connection through-hole, and the anti-deformation assembly may be connected to the lens unit to apply an action force to the lens unit to cause the lens unit to fit the light source panel.

The present disclosure also provides a method of manufacturing a lighting fixture. The method may include providing a housing, a light source assembly, a lens cover, and an anti-deformation assembly; connecting the housing with the lens cover to form a mounting space; mounting the light source assembly in the mounting space and providing the light source assembly with a light source panel, and a connection through-hole in the light source panel; providing the lens cover with a cover body and a lens unit on the cover body; and providing a part of the anti-deformation assembly in the connection through-hole, and connecting the anti-deformation assembly to the lens unit to apply an action force to the lens unit to cause the lens unit to fit the light source panel.

It is to be understood that both the foregoing general description and the following detailed description are exemplary and explanatory only and are not restrictive of the present disclosure.

BRIEF DESCRIPTION OF THE DRAWINGS

The drawings described here are used to provide a further understanding of the present disclosure and constitute a part of the present disclosure. The examples of the present disclosure and the description thereof are used to explain the present disclosure and do not constitute an improper limitation of the present disclosure. In the drawings.

DETAILED DESCRIPTION

Figure 1:
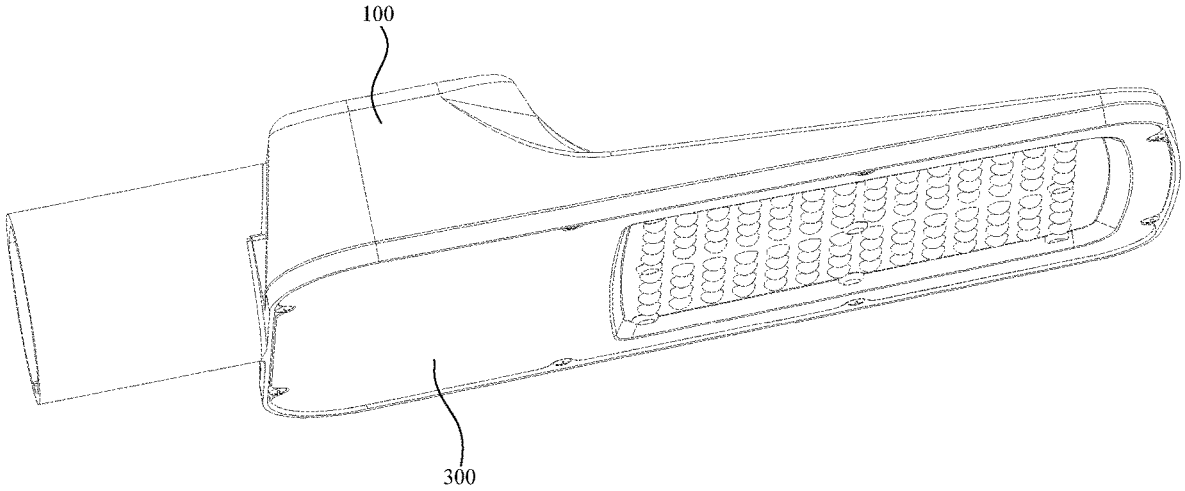
FIG. 1 is a structure schematic diagram of a lighting fixture disclosed in an example of the present disclosure.

The technical solutions of the present disclosure are described below with examples and corresponding accompanying drawings of the present disclosure. The described examples are merely a part of the examples of the present disclosure, rather than all the examples. Based on the examples of the present disclosure, all other examples obtained by those of ordinary skill in the art without creative effort belong to the protection scope of the present disclosure.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Description of reference numerals used in this disclosure may include:

100—housing, 110—accommodating groove, 111—top wall, 120—limiting groove, 130—sealing rib, 200—light source assembly, 210—light source panel, 211—connection through-hole, 300—lens cover, 310—cover body, 320—lens unit, 330—second sealing groove, 340—vent hole, 400—anti-deformation assembly, 410—connection rib, 411—connection portion, 412—fastening portion, 412*a*—fastening surface, 412*b*—V-shaped guide surface, 420—elastic clip, 421—strip body portion, 422—first snap-fit portion, 423— second snap-fit portion, 430—elastic clamping member, 431—mounting piece, 432—first clamping piece, 433—second clamping piece, 500—driver, 600—seal, 610—first sealing groove, 620—first sealing protrusion, 630—second sealing protrusion, and 700—threaded fastener.

During working of the street lamp, the components, such as the light-emitting units and the driver, may generate heat, the components, such as the light source panel and the light distribution element, are easy to deform under an action of the heat, to cause changes in relative positions of the light-emitting units and the light distribution element, thereby resulting in unsatisfactory lighting effects of the lighting fixture.

As shown in FIG. 1 to FIG. 9, an example of the present disclosure discloses a lighting fixture that may be a street lamp, including a housing 100, a light source assembly 200, a lens cover 300, an anti-deformation assembly 400, and a driver 500. The housing 100 and the lens cover 300 are connected and form a mounting space, specifically, the housing 100 and the lens cover 300 may be connected through threaded fasteners 700, thereby facilitating disassembly and maintenance of the lighting fixture. The light source assembly 200 is mounted in the mounting space and specifically includes a light source panel 210 and a light-emitting unit (not shown in the figures) arranged on the light source panel 210, and the light source panel 210 is provided with a connection through-hole 211. The lens cover 300 includes a cover body 310 and a lens unit 320 arranged on the cover body 310, the lens unit 320 may cover the light-emitting unit, and light from the light-emitting unit is emitted through the lens unit 320. A part of the anti-deformation assembly 400 is located in the connection through-hole 211, and the anti-deformation assembly 400 is connected to the lens unit 320 to apply an action force to the lens unit 320 to enable the lens unit to fit the light source panel 210. The driver 500 may be mounted in the mounting space mentioned above, and is electrically connected to the light source panel 210 to drive the light-emitting unit to emit light.

By adopting the above structure, when the light source panel 210 or the lens unit 320 trends to deform under the heat, relative positions of the lens unit 320 and the light source panel 210 are not easy to change due to an effect of the anti-deformation assembly 400; thus, deformations of the light source panel 210 and the lens unit 320 may be limited, to enable a relative position relationship between the components, such as the light-emitting units and the lens unit, to be more stable, thereby improving the lighting effects of the lighting fixture.

Figure 2:
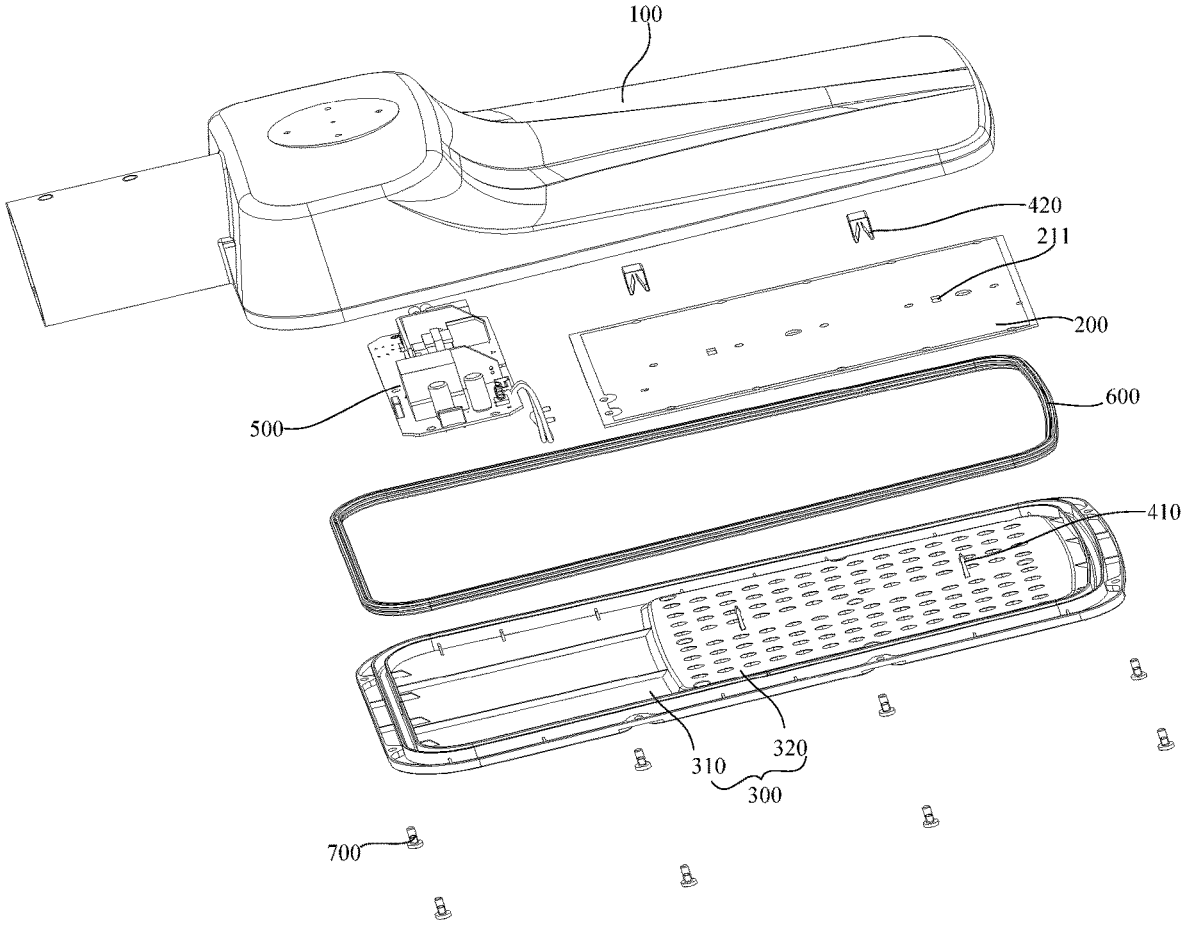
FIG. 2 is an exploded view of the lighting fixture disclosed in an example of the present disclosure.
Figure 3:
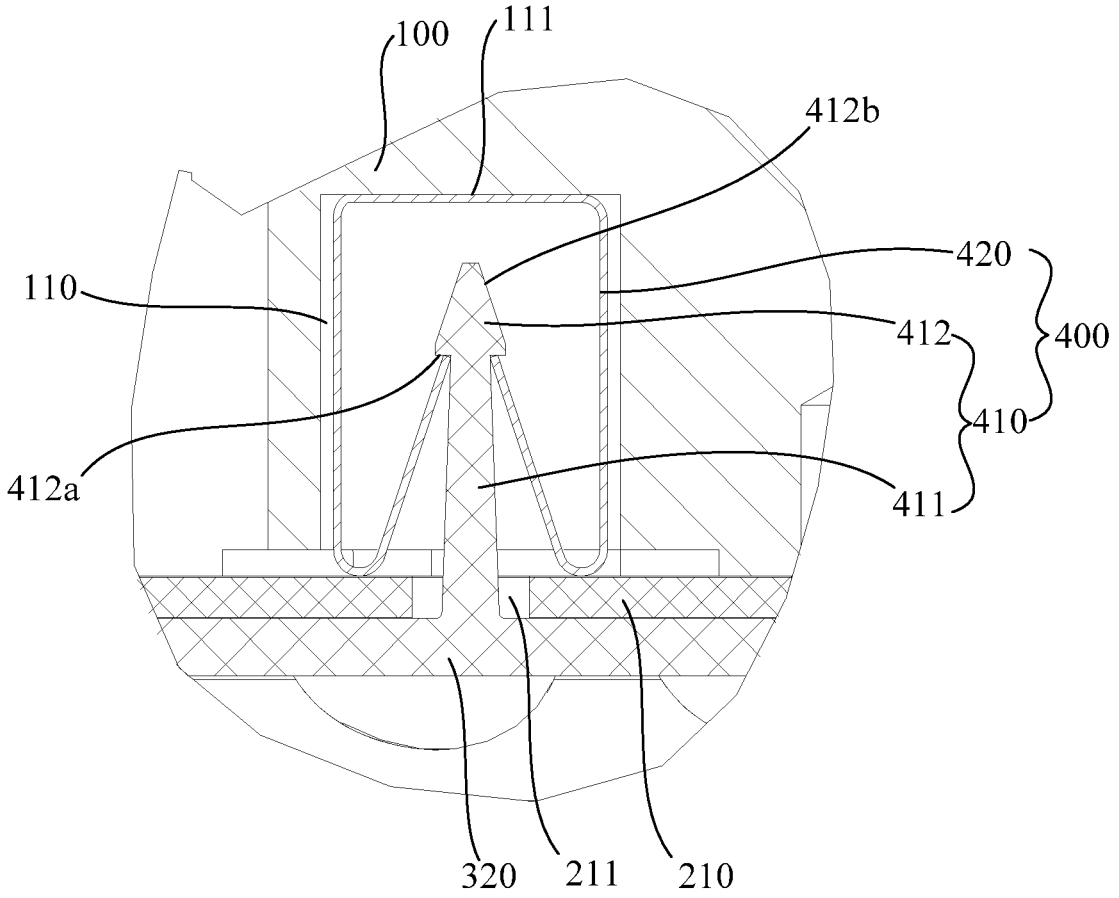
FIG. 3 is a partial sectional view of the structure as shown in FIG. 2.
Figure 4:
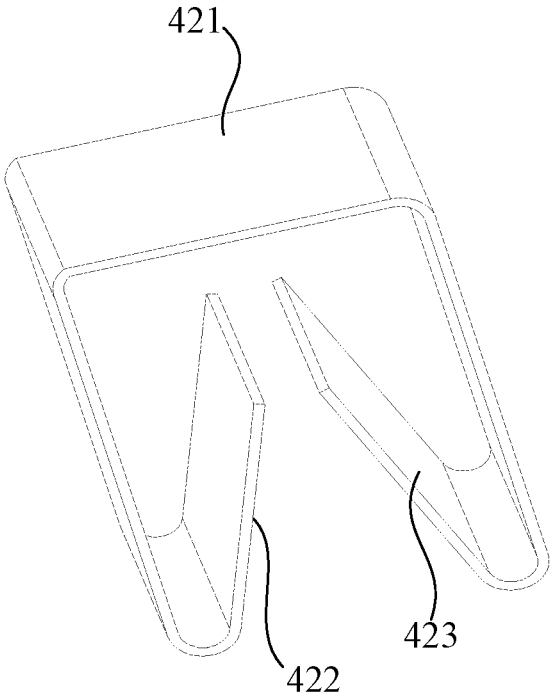
FIG. 4 is a structure schematic diagram of an elastic clip of the lighting fixture disclosed in an example of the present disclosure.

As shown in FIG. 2 to FIG. 4, in an example, the anti-deformation assembly 400 includes a connection rib 410 and an elastic clip 420. One end of the connection rib 410 is connected to the lens unit 320, and the other end of the connection rib 410 penetrates the connection through-hole 211, and is in snap-fit with the elastic clip 420. In order to improve a connection strength of the anti-deformation assembly 400 and the lens unit 320, the connection rib 410 may be integrally formed with the lens unit 320. After the connection rib 410 and the elastic clip 420 are in snap fit correspondingly, the elastic clip 420 is abutted against the light source panel 210 so that the position of the elastic clip 420 relative to the light source panel 210 is limited to further limit the position of the connection rib 410, so as to apply an action force to the lens unit 320 to enable the lens unit 320 to fit the light source panel 210. In such an example, the connection between the connection rib 410 and the elastic clip 420 is reliable, thereby resulting in a more reliable fitting between the lens unit 320 and the light source panel 210.

Specifically, the housing 100 may be provided with an accommodating groove 110, the elastic clip 420 is located in the accommodating groove 110, correspondingly, so that the structure of the lighting fixture is more compact. Besides, in the matching process of the connection rib 410 and the elastic clip 420, the accommodating groove 110 may assist in limiting the position of the elastic clip 420 to achieve the more reliable matching between the connection rib 410 and the elastic clip 420.

Alternatively, the elastic clip 420 includes a strip body portion 421, a first snap-fit portion 422, and a second snap-fit portion 423, the first snap-fit portion 422 and the second snap-fit portion 423 are respectively arranged at two ends of the strip body portion 421; the first snap-fit portion 422 and the second snap-fit portion 423 are in opposite arrangement to form a snap-fit gap therebetween; the connection rib 410 is locked in the snap-fit gap; and both a joint between the strip body portion 421 and the first snap-fit portion 422 and a joint between the strip body portion 421 and the second snap-fit portion 423 are abutted against the light source panel 210. As the strip body portion 421 has a certain elasticity, the first snap-fit portion 422 and the second snap-fit portion 423 may deform appropriately to allow the connection rib 410 to be locked in the snap-fit gap easily, in a process of locking the connection rib 410 in the snap-fit gap. After the connection rib 410 is locked in place, the first snap-fit portion 422 and the second snap-fit 423 are reset, to reliably prevent the connection rib 410 from releasing from the snap-fit gap. In addition, because abutting portions of the elastic clip 420 and the light source panel 210 are distributed on two opposite sides of the connection rib 410, the elastic clip 420 has a high stability in position relative to the light source panel 210, thereby effectively overcoming an action force generated by reasons, such as heating of the components, to guarantee the lighting effects of the lighting fixture.

To facilitate operators to connect the connection rib 410 and the elastic clip 420 together, the connection rib 410 includes a connection portion 411 and a fastening portion 412. The fastening portion 412 is connected to the lens unit 320 through the connection portion 411, and has a fastening surface 412*a* protruding relative to the connection portion 411 and a V-shaped guide surface 412*b* connected to the fastening surface 412. The fastening surface 412*a* is abutted against the first snap-fit portion 422 and the second snap-fit portion 423, and the V-shaped guide surface 412*b* is located at a side, away from the light source panel 210, of the fastening surface 412*a*. In the process of locking the connection rib 410 in the corresponding snap-fit gap, the V-shaped guide surface 412*b* is in slide fit with the first snap-fit portion 422 and the second snap-fit portion 423. Because a dimension of a part of the V-shaped guide surface 412*b* matched with the first snap-fit portion 422 and the second snap-fit portion 423 is small, the first snap-fit portion 422 and the second snap-fit portion 423 are easy to be opened. In addition, a bonding force between the first snap-fit portion 422 and the second snap-fit portion 423 is high, which improves a snap-fit reliability to a certain degree.

The structure of the edge of the first snap-fit portion 422 and the structure of the edge of the second snap-fit portion 423 may be flexibly arranged. In order to expand an action area between the first snap-fit portion 422 and the second snap-fit portion 423 and the fastening portion 412, to improve the connection strength, the edge of the first snap-fit portion 422 and the edge of the second snap-fit portion 423 are set as strip edges, while the fastening surface 412*a* is set as a strip surface that extends along a direction parallel to extension directions of the strip edges.

Alternatively, a lateral dimension of the snap-fit gap mentioned above is gradually reduced in a direction gradually away from the light source panel 210. It should be noted that the lateral direction is parallel to a direction in which the first snap-fit portion 422 and the second snap-fit portion 423 face each other. With the arrangement, the matching between the first snap-fit portion 422 and the second snap-fit portion 423 and the fastening portion 412 is much smooth, to facilitate an assembling operation of the lighting fixture.

In order to simplify the structure of the elastic clip 420, both the first snap-fit portion 422 and the second snap-fit portion 423 may be of plate structures, which form a V-shaped structure.

In addition, to simplify the structure of the elastic clip 420, the strip body portion 421 may be of a U-shaped structure. The first snap-fit portion 422 and the second snap-fit portion 423 may be located inside the strip body portion 421. Further, each accommodating groove 110 has a top wall 111 facing the light source panel 210; the top wall 111 may be of a planer structure; and a top of the strip body portion 421 is abutted against the top wall 111. In such a structure, an abutting area between the elastic clip 420 and the housing 100 is large, and the housing 100 may assist in limiting a deformation amplitude of the elastic clip 420, to prevent the elastic clip 420 from being separated from the corresponding connection rib 410 due to excessive deformation after being stressed.

Figure 5:
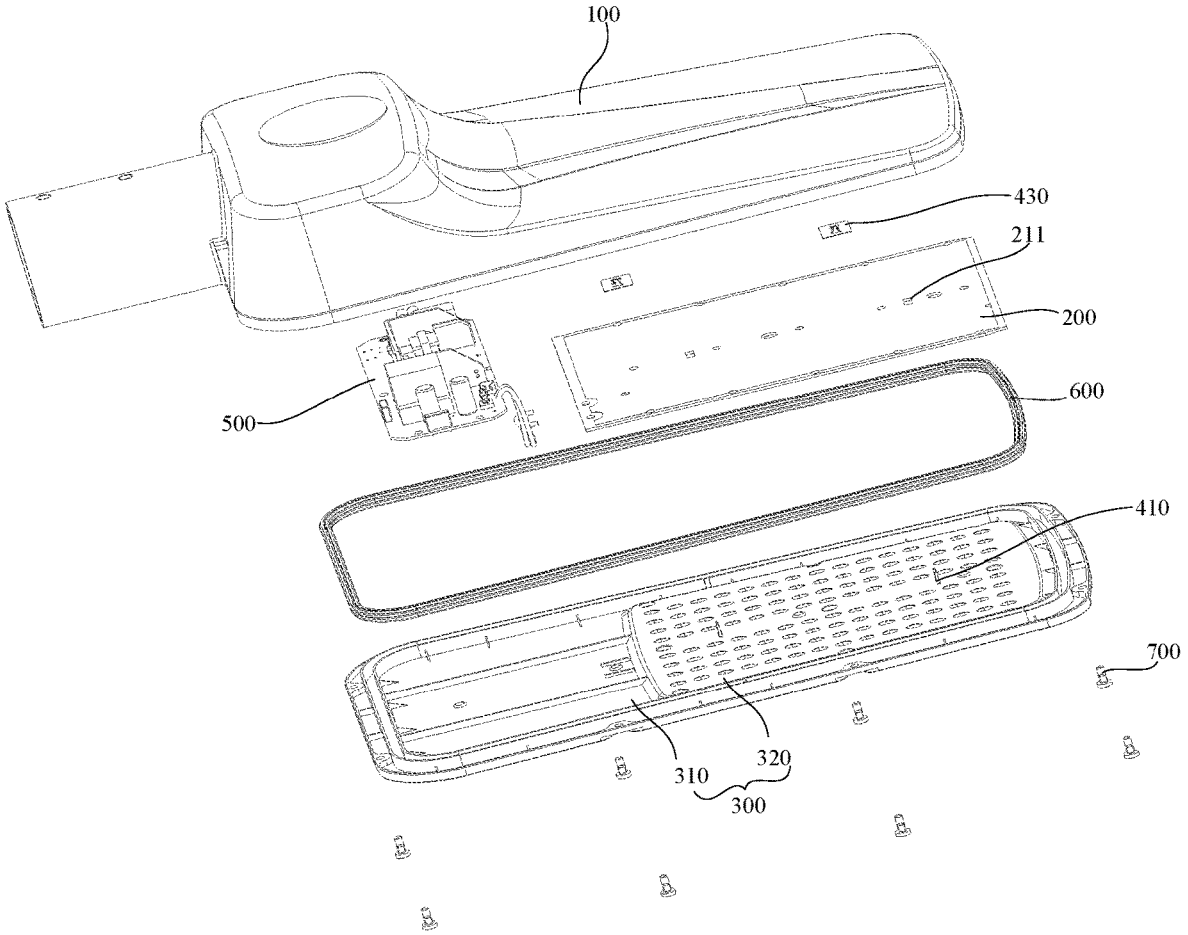
FIG. 5 is an exploded view of a lighting fixture disclosed in another example of the present disclosure.
Figure 6:
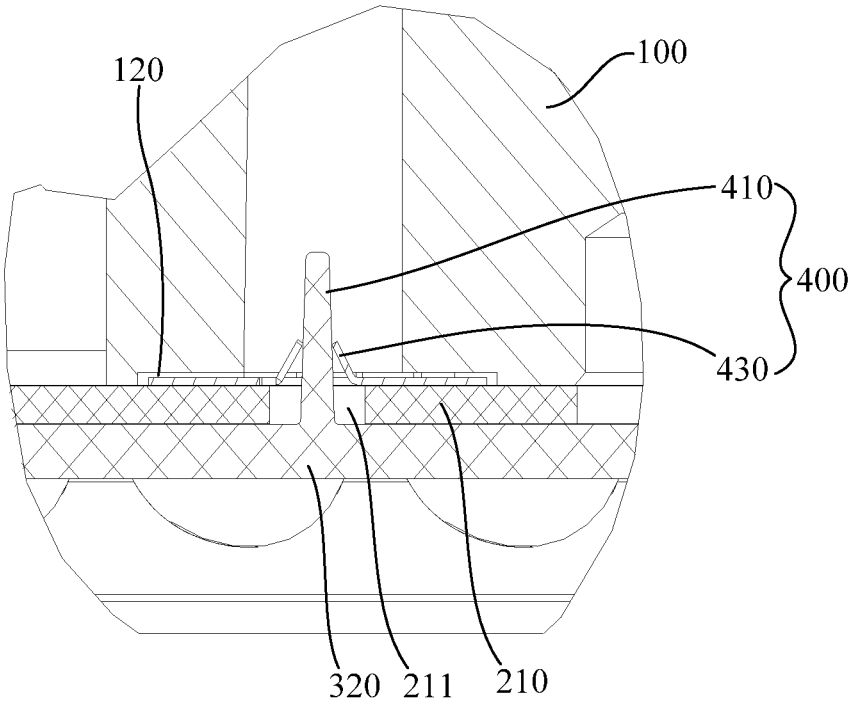
FIG. 6 is a partial sectional view of the structure as shown in FIG. 5.
Figure 7:
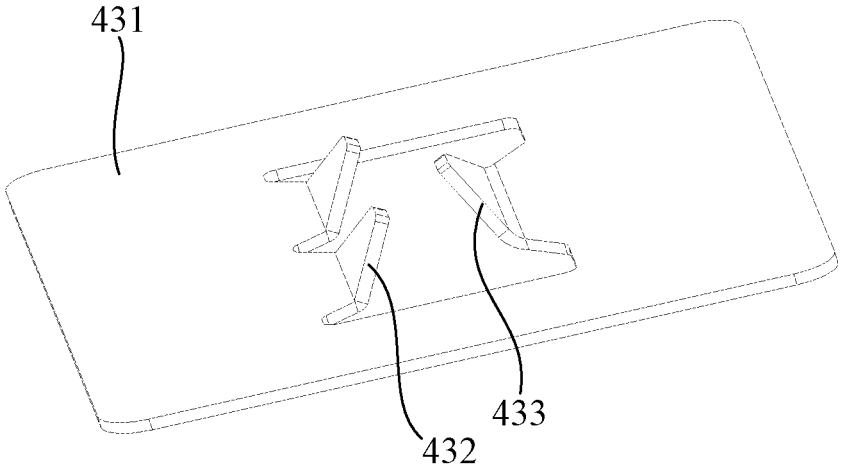
FIG. 7 is a structure schematic diagram of an elastic clamping member in the structure as shown in FIG. 5.

As shown in FIG. 5 to FIG. 7, in another example, the anti-deformation assembly further includes a connection rib 410 and an elastic clamping member 430. The elastic clamping member 430 has a clamping gap. One end of the connection rib 410 is connected to the lens unit 320, the other end of the connection rib 410 penetrates the connection through-hole 211, and is inserted into the clamping gap. The elastic clamping member 430 is abutted against the light source panel 210, and applies a clamping force to the connection rib 410. Also, the anti-deformation assembly 400 and the connection rib 410 keep connected by a frictional force therebetween. The connection mode may meet requirements for the connection strength on one hand, and on the other hand, may simplify the structure of the anti-deformation assembly 400.

Further, in order to prevent the elastic clamping member 430 from moving along a direction away from the light source panel 210 during a process of inserting the connection rib 410 into the clamping gap, a limiting groove 120 may be formed in the housing 100, and at least a part of the elastic clamping member 430 is located in the limiting groove 120. When the elastic clamping member 430 has a moving trend mentioned above, an inner surface of the limiting groove 120 may prevent the elastic clamping member 430 moving, thereby allowing the connection rib 410 to be reliably inserted into the clamping gap.

In the example of the present disclosure, the elastic clamping member 430 may include a mounting piece 431, and a first clamping piece 432 and a second clamping piece 433 which are arranged on the mounting piece 431. The mounting piece 431 is abutted against the light source panel 210, both the first clamping piece 432 and the second clamping piece 433 protrude towards a direction away from the light source panel 210 relative to the mounting piece 431, and the clamping gap is formed between the first clamping piece 432 and the second clamping piece 433. The first clamping piece 432 and the second clamping piece 433 have a certain elasticity; in a process of inserting the connection rib 410 into the clamping gap, the connection rib 410 applies the enough action force to the first clamping piece 432 and the second clamping piece 433 to deform them, so that the connection rib 410 may be inserted into the clamping gap therebetween. The first clamping piece 432 and the second clamping piece 433 deform to apply reaction forces to the connection rib 410 to increase a frictional force between the two clamping pieces and the connection rib 410, thereby achieving an effect of improving a reliability in connection.

An amount of the first clamping piece 432 and the second clamping piece 433 may be one, and abutting positions of the first clamping piece 432 and the second clamping piece 433 and the connection rib 410 are opposite to a thickness direction of the connection rib 410, thereby applying an effective action force. To further increase the action force, the amount of at least one of the group consisting of the first clamping piece 432 and the second clamping piece 433 may be multiple; thus, a clamping force formed between the first clamping piece 432 and the second clamping piece 433 and the connection rib 410 may be increased by increasing joint points.

To further improve the clamping force formed between the first clamping piece 432 and the second clamping piece 433 and the connection rib 410, the first clamping piece 432 and the second clamping piece 433 may be in staggered arrangement. As shown in FIG. 7, taking the arrangement of two first clamping pieces 432 and one second clamping piece 433 as an example, the second clamping piece 433 is arranged in a gap between the two first clamping pieces 432, thereby achieving a structural form in staggered arrangement.

Alternatively, a lateral dimension of the clamping gap is gradually reduced in a direction gradually away from the light source panel 210. It should be noted that the lateral direction is parallel to the direction in which the first clamping piece 432 and the second clamping piece 433 face each other. With the arrangement, the matching between the first clamping piece 432 and the second clamping piece 433, and the connection rib 410 is much smooth, to facilitate an assembling operation of the lighting fixture.

Figure 8:
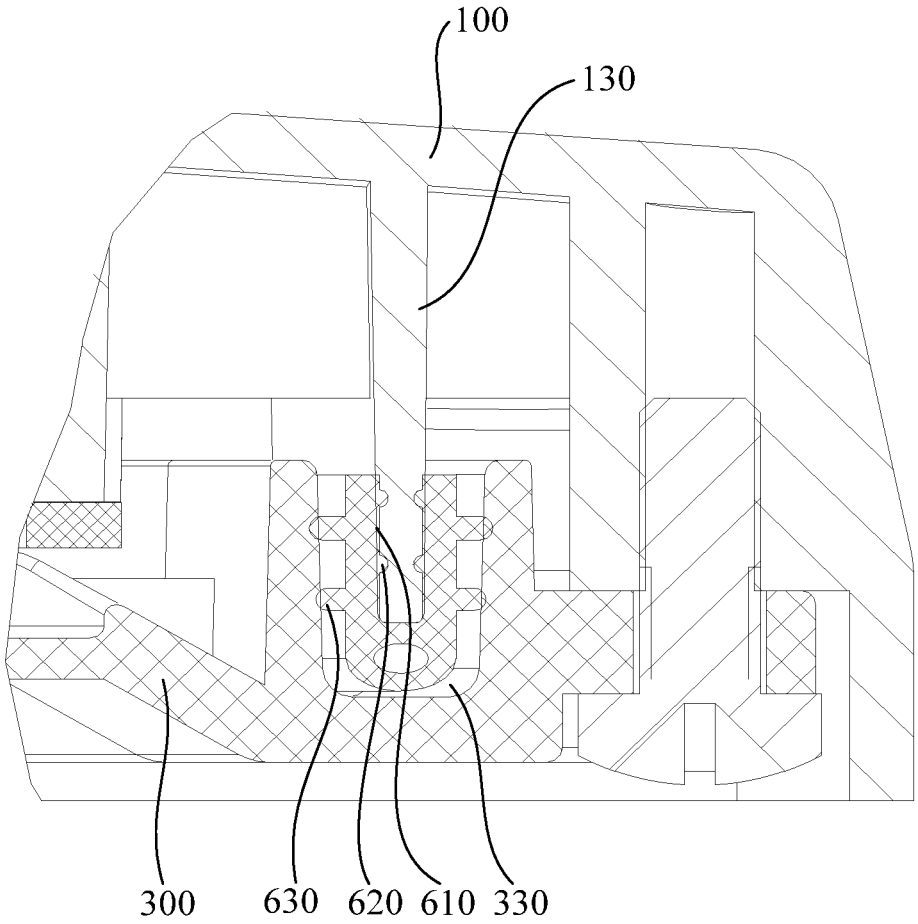
FIG. 8 is a partial sectional view of the lighting fixture disclosed in an example of the present disclosure.

To guarantee an airtightness of the lighting fixture, a seal 600 may be arranged between the housing 100 and the lens cover 300. As shown in FIG. 8, the seal 600 has a first sealing groove 610, and a first sealing protrusion 620 is provided on a wall of the first sealing groove 610; the housing 100 is provided with a sealing rib 130 that is inserted into the first sealing groove 610, and a surface of the sealing rib 130 is abutted against the first sealing protrusion 620. With the arrangement of the first sealing protrusion 620, in a process of inserting the sealing rib 130 into the first sealing groove 610, the sealing rib 130 applies an action force to the first sealing protrusion 620 to deform the first sealing protrusion 620, so that a high pressing force is formed between the sealing rib 130 and the first sealing protrusion 620, and the airtightness therebetween is improved.

Similarly, the lens cover 300 has a second sealing groove 330. The seal 600 is arranged in the second sealing groove 330. A second sealing protrusion 630 is arranged on an outer surface of the seal 600, and is abutted against a wall of the second sealing groove 330. In the process of inserting the sealing rib 130 into the first sealing groove 610, the sealing rib 130 pushes the seal 600, the second sealing protrusion 630 is pressed to the wall of the second sealing groove 330, and a close fit between the second sealing protrusion 630 and the second sealing groove 330 may be achieved, thereby improving the airtightness of the lighting fixture.

To further improve a sealing effect, the amount of at least one of the group consisting of the first sealing protrusion 620 and the second sealing protrusion 630 may be multiple. The multiple first sealing protrusions 620 and/or the multiple second sealing protrusions 630 are arranged along an extension direction of the sealing rib 130.

Figure 9:
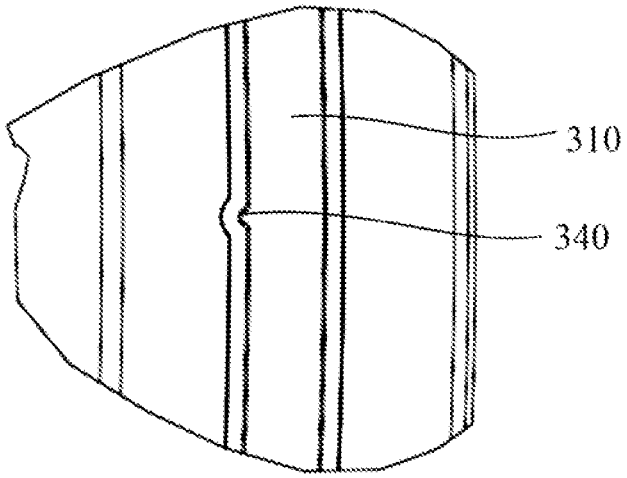
FIG. 9 is a structure schematic diagram of a vent hole of the lighting fixture disclosed in an example of the present disclosure.

In the case of assembling of the lighting fixture, there is air in the second sealing groove 330, after air in the second sealing groove 330 is quickly exhausted, the seal 600 may be quickly assembled, while the airtightness between the seal 600 and the lens cover 300 may be guaranteed. Thus, as shown in FIG. 9, a vent hole 340, running through to a top edge of the second sealing groove 330, may be formed in the wall of the second sealing groove 330. Air in the second sealing groove 330 may be exhausted through the vent hole 340. A size of the vent hole 340 should not be too large or too small; if the size is too large, an adverse effect will be caused on the final sealing effect, and if the size is too small, an exhaust effect will be weakened.

The present disclosure provides a lighting fixture to improve the lighting effect of the lighting fixture.

A lighting fixture, comprising a housing, a light source assembly, a lens cover, and an anti-deformation assembly. The housing and the lens cover are connected and form a mounting space; the light source assembly is mounted in the mounting space and includes a light source panel, and a connection through-hole is provided in the light source panel; the lens cover includes a cover body and a lens unit on the cover body; and a part of the anti-deformation assembly is in the connection through-hole, and the anti-deformation assembly is connected to the lens unit to apply an action force to the lens unit to cause the lens unit to fit the light source panel.

The present disclosure also provides a method of manufacturing a lighting fixture. The method may include providing a housing, a light source assembly, a lens cover, and an anti-deformation assembly; connecting the housing with the lens cover to form a mounting space; mounting the light source assembly in the mounting space and providing the light source assembly with a light source panel, and a connection through-hole in the light source panel; providing the lens cover with a cover body and a lens unit on the cover body; and providing a part of the anti-deformation assembly in the connection through-hole, and connecting the anti-deformation assembly to the lens unit to apply an action force to the lens unit to cause the lens unit to fit the light source panel.

The method may include providing the anti-deformation assembly with a connection rib and an elastic clip; connecting one end of the connection rib to the lens unit, and penetrating, by the other end of the connection rib, the connection through-hole where the other end of the connection rib may be in snap fit with the elastic clip; and abutting the elastic clip against the light source panel.

The method may include providing the elastic clip with a strip body portion, where a first snap-fit portion and a second snap-fit portion which may be at two ends of the strip body portion; placing the first snap-fit portion and the second snap-fit portion opposite to each other to form a snap-fit gap therebetween; locking the connection rib in the snap-fit gap; and abutting both a joint between the strip body portion and the first snap-fit portion and a joint between the strip body portion and the second snap-fit portion against the light source panel.

Technical solutions adopted in the present disclosure can achieve the following beneficial effects.

In the lighting fixture disclosed in the present disclosure, the light source panel is provided with the connection through-hole for the part of the anti-deformation assembly to penetrate. The anti-deformation assembly is connected to the lens unit to apply the action force to the lens unit to enable the lens unit to fit the light source panel. When the light source panel or the lens unit trends to deform under the heat, relative positions of the lens unit and the light source panel are not easy to change due to an effect of the anti-deformation assembly; thus, deformations of the light source panel and the lens unit may be limited, to enable a relative position relationship between components, such as the light-emitting units and the lens unit, to be more stable, thereby improving the lighting effect of the lighting fixture.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The above examples of the present disclosure focus on descriptions of differences among various examples. The different optimization features among the various examples may be combined to form a more optimal example as long as they are not contradictory. Considering the conciseness in writing, it will not be repeated here.

The above descriptions are only examples of the present disclosure and are not intended to limit the present disclosure. Any modification, equivalent replacement, improvement, etc. made within the spirit and principle of the present disclosure shall be included in the protection scope of the present disclosure.

What is claimed is:

1. A lighting fixture, comprising a housing, a light source assembly, a lens cover, and an anti-deformation assembly, wherein:

the housing and the lens cover are connected and form a mounting space;

the light source assembly is mounted in the mounting space and comprises a light source panel, and a connection through-hole is provided in the light source panel;

the lens cover comprises a cover body and a lens unit on the cover body;

a part of the anti-deformation assembly is in the connection through-hole, and the anti-deformation assembly is connected to the lens unit to apply an action force to the lens unit to cause the lens unit to fit the light source panel; and the anti-deformation assembly comprises a connection rib and an elastic clamping member, the elastic clamping member comprises a mounting piece and a plurality of elastic clamping pieces comprising a first clamping piece and a second clamping piece provided on the mounting piece, the mounting piece is abutted against the light source panel, and the first clamping piece and the second clamping piece protrude towards a direction away from the light source panel relative to the mounting piece.

2. The lighting fixture according to claim 1, wherein:

the anti-deformation assembly further comprises an elastic clip;

one end of the connection rib is connected to the lens unit, and the other end of the connection rib penetrates the connection through-hole and is in snap fit with the elastic clip; and the elastic clip is abutted against the light source panel.

3. The lighting fixture according to claim 2, wherein:

the elastic clamping member comprises a clamping gap;

one end of the connection rib is connected to the lens unit, and the other end of the connection rib penetrates the connection through-hole and is inserted into the clamping gap; and the elastic clamping member is abutted against the light source panel and applies a clamping force to the connection rib.

4. The lighting fixture according to claim 3, wherein:

the clamping gap is formed between the first clamping piece and the second clamping piece.

5. The lighting fixture according to claim 4, wherein an amount of at least one of: the first clamping piece and the second clamping piece is multiple.

6. The lighting fixture according to claim 5, wherein the first clamping piece and the second clamping piece are in staggered arrangement.

7. The lighting fixture according to claim 4, wherein a lateral dimension of the clamping gap is gradually reduced in a direction gradually away from the light source panel, and the lateral direction is parallel to a direction in which the first clamping piece and the second clamping piece face each other.

8. The lighting fixture according to claim 2, wherein:

the elastic clip comprises a strip body portion, and a first snap-fit portion and a second snap-fit portion which are at two ends of the strip body portion;

the first snap-fit portion and the second snap-fit portion are opposite to each other to form a snap-fit gap therebetween;

the connection rib is locked in the snap-fit gap; and both a joint between the strip body portion and the first snap-fit portion and a joint between the strip body portion and the second snap-fit portion are abutted against the light source panel.

9. The lighting fixture according to claim 8, wherein:

the connection rib comprises a connection portion and a fastening portion;

the fastening portion is connected to the lens unit through the connection portion, and has a fastening surface protruding relative to the connection portion and a V-shaped guide surface connected to the fastening surface;

the fastening surface is abutted against the first snap-fit portion and the second snap-fit portion; and the V-shaped guide surface is on a side, away from the light source panel, of the fastening surface.

10. The lighting fixture according to claim 8, wherein a lateral dimension of the snap-fit gap is gradually reduced in a direction gradually away from the light source panel, and the lateral direction is parallel to a direction in which the first snap-fit portion and the second snap-fit portion face each other.

11. The lighting fixture according to claim 8, wherein the strip body portion is of a U-shaped structure.

12. The lighting fixture according to claim 1, wherein a seal is between the housing and the lens cover; the lens cover is provided with a second sealing groove, the seal is in the second sealing groove, and a vent hole runs through to a top edge of the second sealing groove.

13. The lighting fixture according to claim 1, wherein the lighting fixture comprises a street lamp.

14. The lighting fixture according to claim 1, wherein the connection rib applies action forces to the first clamping piece and the second clamping piece, and the first clamping piece and the second clamping piece deform to apply reaction forces to the connection rib.

15. A method of manufacturing a lighting fixture, comprising:

providing a housing, a light source assembly, a lens cover, and an anti-deformation assembly;

connecting the housing with the lens cover to form a mounting space;

mounting the light source assembly in the mounting space and providing the light source assembly with a light source panel, and a connection through-hole in the light source panel;

providing the lens cover with a cover body and a lens unit on the cover body;

providing a part of the anti-deformation assembly in the connection through-hole, and connecting the anti-deformation assembly to the lens unit to apply an action force to the lens unit to cause the lens unit to fit the light source panel;

providing a connection rib and an elastic clamping member in the anti-deformation assembly;

providing a mounting piece and a plurality of elastic clamping pieces on the elastic lamping member, wherein the plurality of elastic clamping pieces comprise a first clamping piece and a second clamping piece;

protruding the first clamping piece and the second clamping piece towards a direction away from the light source panel relative to the mounting piece; and abutting the mounting piece against the light source panel.

16. The method according to claim 15, further comprising:

providing the anti-deformation assembly with an elastic clip;

connecting one end of the connection rib to the lens unit, and penetrating, by the other end of the connection rib, the connection through-hole wherein the other end of the connection rib is in snap fit with the elastic clip; and abutting the elastic clip against the light source panel.

17. The method according to claim 16, further comprising:

providing the elastic clip with a strip body portion, wherein a first snap-fit portion and a second snap-fit portion which are at two ends of the strip body portion;

placing the first snap-fit portion and the second snap-fit portion opposite to each other to form a snap-fit gap therebetween;

locking the connection rib in the snap-fit gap; and abutting both a joint between the strip body portion and the first snap-fit portion and a joint between the strip body portion and the second snap-fit portion against the light source panel.

18. The method according to claim 15, wherein the connection rib applies action forces to the first clamping piece and the second clamping piece, and the first clamping piece and the second clamping piece deform to apply reaction forces to the connection rib.

* * * * *